US006501971B1

(12) United States Patent
Wolf et al.

(10) Patent No.: US 6,501,971 B1
(45) Date of Patent: Dec. 31, 2002

(54) MAGNETIC FERRITE MICROWAVE RESONATOR FREQUENCY ADJUSTER AND TUNABLE FILTER

(75) Inventors: Stuart A. Wolf, Bowie, MD (US); Frederic J. Rachford, Washington, DC (US); John Claassen, Washington, DC (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 1035 days.

(21) Appl. No.: 08/739,981

(22) Filed: Oct. 30, 1996

(51) Int. Cl.[7] ..... H01P 1/218

(52) U.S. Cl. ..... 505/210; 333/204; 333/219.2; 333/235

(58) Field of Search ..... 333/204, 205, 333/219, 219.2, 235, 995, 126; 505/210

(56) References Cited

U.S. PATENT DOCUMENTS 3,611,197 A * 10/1971 Moore et al. ..... 333/204 X
3,681,716 A * 8/1972 Chiron et al. ..... 333/204 X
3,766,494 A * 10/1973 Anbe et al. ..... 333/235 X
5,512,539 A * 4/1996 Matsuura et al. ..... 333/204 X

FOREIGN PATENT DOCUMENTS

JP 0190001 * 7/1989 ..... 333/204

OTHER PUBLICATIONS

Trotel et al., "Magnetically tunable YBaCuO microstrip resonators and bandpass filters", Appl. Phys. Lett. 68(18), pp. 2559–2561, Apr. 29, 1999.*

* cited by examiner

*Primary Examiner*—Seungsook Ham
(74) *Attorney, Agent, or Firm*—John J. Karasek; Joseph T. Grunkemeyer

(57) ABSTRACT

A magnetic ferrite microwave resonator frequency tunable filter and method for tuning a filter having both a resonator portion and a tuning portion. The resonator portion has an input for receiving an electromagnetic signal and an output for emitting an electromagnetic signal. A tuning portion includes a magnetic ferrite element disposed in first and second magnetic fields generated by a fixed magnet and an electromagnet. The magnetic ferrite element has a magnetic permeability determined by the first and second magnetic fields. The first magnetic field places a ferromagnetic resonance frequency of the ferrite element near a frequency of the electromagnetic signal transmitted by the resonator portion. The second magnetic field is variable in response to a varying current supplied to the electromagnet to change the permeability of the ferrite element, to thereby alter the center frequency of the resonator, thereby facilitating tuning of the electromagnetic signal.

18 Claims, 3 Drawing Sheets

MAGNETIC FERRITE MICROWAVE RESONATOR FREQUENCY ADJUSTER AND TUNABLE FILTER

BACKGROUND OF THE INVENTION

1. Field of the Invention

The present invention relates to a magnetic ferrite microwave resonator and more particularly to a magnetic ferrite microwave resonator including a magnet to bias a ferrite in the resonator so that the resonator is sensitive to changes in an applied magnetic field to provide tunability.

2. Discussion of the Related Art

Microwave resonators are frequently used in narrow band filter applications. These resonator structures can include superconductive materials and have a resonant frequency and quality factor fixed by the geometry of the resonator and the intrinsic microwave impedance of the elements that make up the resonator. Generally, a resonator receives a signal and only allows the portion of the signal at a specific frequency, the resonant frequency, to pass. Different applications of the resonator frequently require that different frequencies be passed. Therefore, some frequency tunability of the resonant frequency is desired.

Tunability may be achieved by providing a ferroelectric material near the resonator and adjusting a voltage applied to the resonator to bias ferroelectrics in the resonator. Some devices currently in use, apply an electric field directly to the ferroelectrics to adjust the permittivity of ferroelectric materials in the vicinity of the resonant structure. Ferroelectric materials, however, have intrinsically broad microwave losses and can severely degrade the performance of high quality resonators.

Efficient filter resonator structures have a high Q value, which is the electrical gain/loss ratio (Q) equal to the resonant frequency ($v_c$) over a change in frequency ($\Delta v$) as shown in the graph of FIG. 1.

U.S. Pat. No. 4,887,052, entitled "Tuned Oscillator Utilizing Thin Film Ferromagnetic Resonator," by Murakami et al., discloses a resonator including a microstrip structure in which the signal line is formed of YIG, a ferromagnetic material, spaced from a ground plane. Thus, the YIG film actually forms part of the resonator microstrip structure and the center frequency of the resonator equal to the ferromagnetic resonance frequency of the YIG film.

SUMMARY OF THE INVENTION

In accordance with the present invention, certain disadvantages of conventional apparatuses are resolved by having an electromagnetic filter comprising a resonator portion with an input for receiving an electromagnetic signal and an output for emitting an electromagnetic signal. A tuning portion is further provided including a magnetic ferrite element coupled to the resonator disposed in first and second magnetic fields generated by a fixed magnet and an electromagnet. Thus the magnetic ferrite element has a magnetic permeability determined by the first and second magnetic fields. Specifically, the first magnetic field places a ferromagnetic resonance frequency of the ferrite element near a frequency of the electromagnetic signal transmitted by the resonator portion. The second magnetic field is variable in response to a varying current supplied to the electromagnet to change the permeability of the ferrite element, to thereby alter the center frequency ($V_c$) of the resonator, thereby facilitating tuning of the electromagnetic signal.

In another embodiment, a bandpass filter includes a plurality of filters connected in parallel where each filter includes a transmission line for transmitting electromagnetic radiation, and a tuning portion that further includes a ferrite element, a permanent magnet for generating a first magnetic field, and an electromagnet for generating a second magnetic field. The ferrite element is disposed in the first and second magnetic fields such that the first magnetic field places a ferromagnetic resonance frequency of the ferrite element near a frequency of the electromagnetic radiation transmitted by the transmission line. The second magnetic field is variable in response to a varying current supplied to the electromagnet to change the permeability of the ferrite element so as to modulate the center frequency and facilitate tuning.

In another embodiment of the present invention, a method is provided for tuning a filter, where the filter includes a ferrite element disposed adjacent a transmission line, an electromagnet, and a permanent magnet. The method includes the steps of generating a magnetic field using the electromagnet, subjecting the ferrite element to the magnetic field generated by the electromagnet, and varying the field generated by the electromagnet to change a magnetic permeability in the ferrite element to modulate the electromagnetic signal carried by the transmission line.

BRIEF DESCRIPTION OF THE DRAWINGS

The accompanying drawings, which are incorporated herein by reference and constitute a part of the specification, and, together with the description, serve to explain the principles of the invention.

In the drawings.

DETAILED DESCRIPTION OF THE PREFERRED EMBODIMENTS

Figure 1:
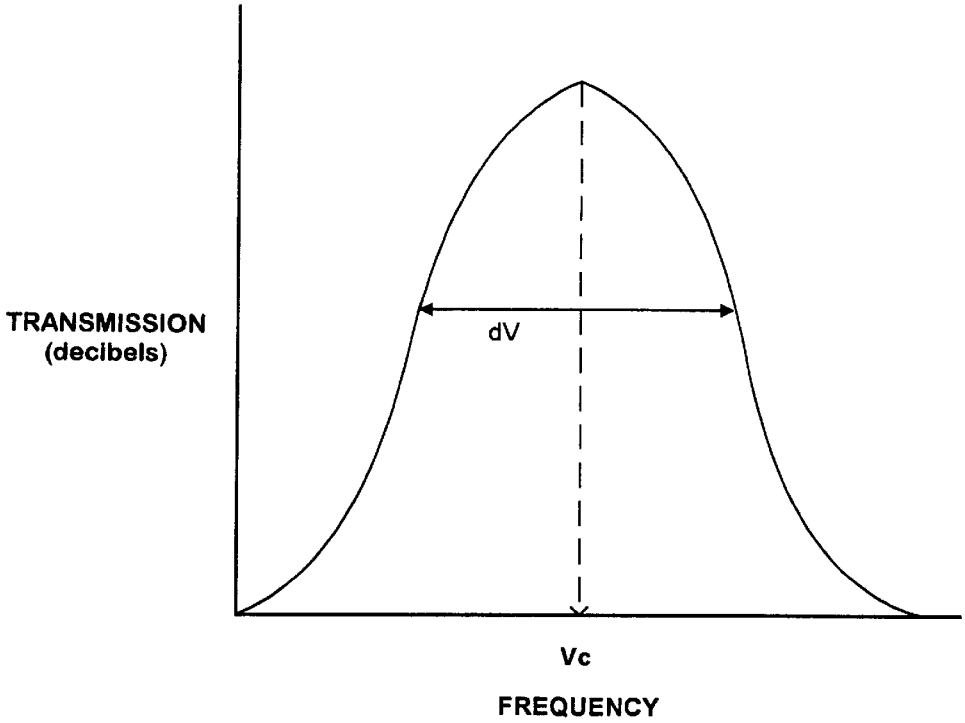
FIG. 1 shows a graph of the transmission in decibels output by a resonator versus a frequency.

Reference will now be made in detail to the construction and operation of preferred implementations of the present invention which are illustrated in the accompanying drawings. In those drawings, like elements and operations are designated with the same reference numerals where possible.

Figure 2A:
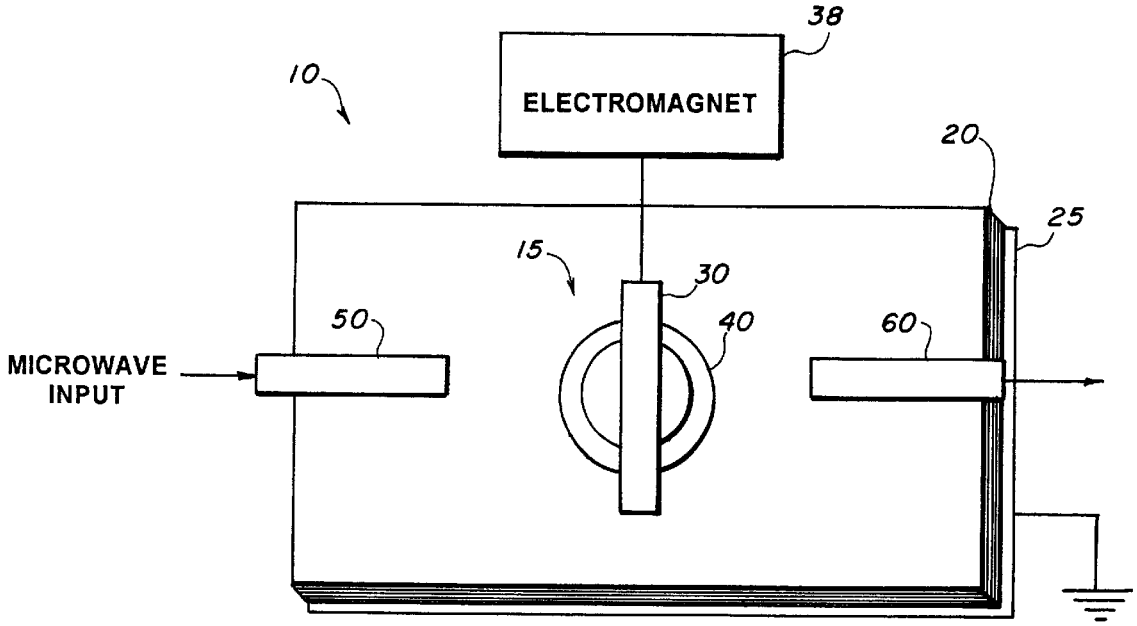
FIG. 2A is a plan view of a microwave resonator structure according to the present invention.

FIG. 2A shows a microwave resonator and tuning structure 10 including an input section 50 for receiving an electromagnetic signal, an output 60 for outputting an electromagnetic signal, and a microstrip ring resonator 40 having at least a portion constructed from a superconductive material. A tuning portion 15 is positioned on a dielectric material layer 20 above a ground plane 25 and includes a non-conductive ferrite material section 30.

Input section 50 receives an electromagnetic signal, such as a microwave input, and passes the received signal through tuning portion 15 to tune or adjust the resonate frequency of the microwave signal. The resulting signal is output by output section 60.

Figure 2B:
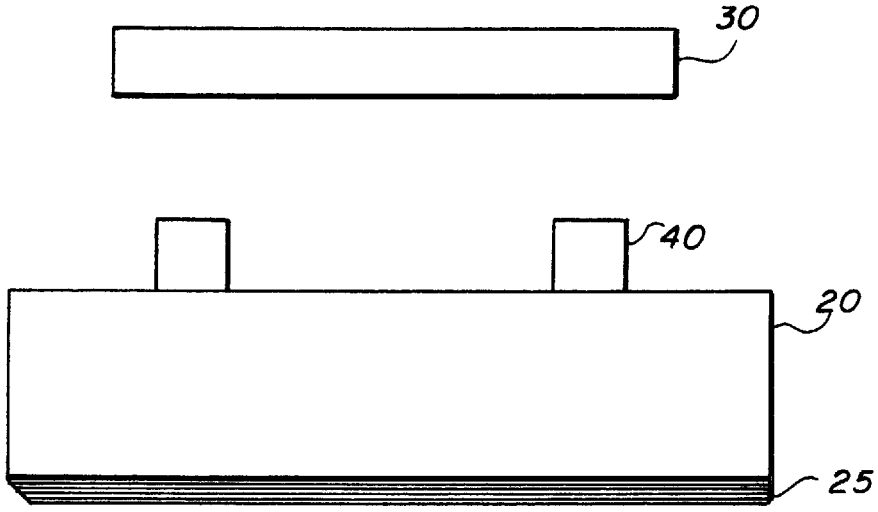
FIG. 2B is a side view of the microwave resonator structure shown in FIG. 2A.

FIG. 2B shows a side view of the microwave resonator structure 10 shown in FIG. 2A. The ferrite material section 30 is shown disposed above the microstrip ring resonator including superconductive material intermingled with non-superconductive material 40, preferably within close proximity, e.g. 1 mm. The structure is positioned on ground plane 25 spaced by dielectric material layer 20. In the shown implementation of the present invention, the microstrip 40 is annular, however any shape may be used. Moreover, transmission line resonator structures can be used such as strip-line structures.

The inductance, and therefore resonance frequency of the ferrite 30, of the resonator 40 varies based on geometry and on the magnetic permeability. In the present invention, the geometry of the resonator 40 may be any shape not only circular. The present invention does not adjust inductance by adjusting the geometry of the resonator 40 but rather by adjusting the magnetic permeability ($\mu$) which is a function of the magnetic field applied to the magnetic material.

The resonant frequency ($\mu$) of the circular resonator 40 is sensitive to the magnetic field applied to the tuner 15 containing ferrite 30. The resonant frequency is most sensitive when the resonator 40 is near the ferromagnetic resonance of the ferrite, that is its natural resonate frequency. The change in resonant frequency is proportional to the square root of the ferrite permeability. When near this resonance, the permeability of the ferrite is greatly changed by a small change in the magnetic field, thereby producing a large change in the resonant frequency output by the resonator structure 10. The resonant frequency of the ferrite could be changed by changing the composition of the ferrite. However, this makes it complicated and costly to adjust the resonant frequency of a filter.

The ferrite section 30 of the tuning portion 15 may be constructed in a variety of configurations that magnetically bias the ferrite to have a ferromagnetic resonate frequency just above or below the microwave resonator frequency in the absence of the ferrite or when the ferromagnetic resonance is far from the microwave resonant frequency. In this configuration, the magnetic permeability is a strong function of the biasing magnetic field such that small changes in the magnetic field can create these large changes in permeability. That is, small changes in the magnetic field bias applied to the ferrite 30, by electromagnet 38, will shift the ferrite's ferromagnetic resonance and change the frequency dependent magnetic permeability ($\mu$) of the material with no change in the permittivity of the ferrite ($\in$). The electrical length of the portion of the microwave flux threading the ferrite will change proportional to the square root of the permeability times the permittivity $(\in\mu)^{1/2}$. This change in the electrical length and induced phase shift will change the resonate frequency for the coupled microwave resonator/ferrite system.

Typically the ferrite is biased to have a resonant frequency near, but not equal to, the resonant frequency of the resonator. This is because the ferrite has very high losses at the ferromagnetic resonator frequency.

Figure 3:
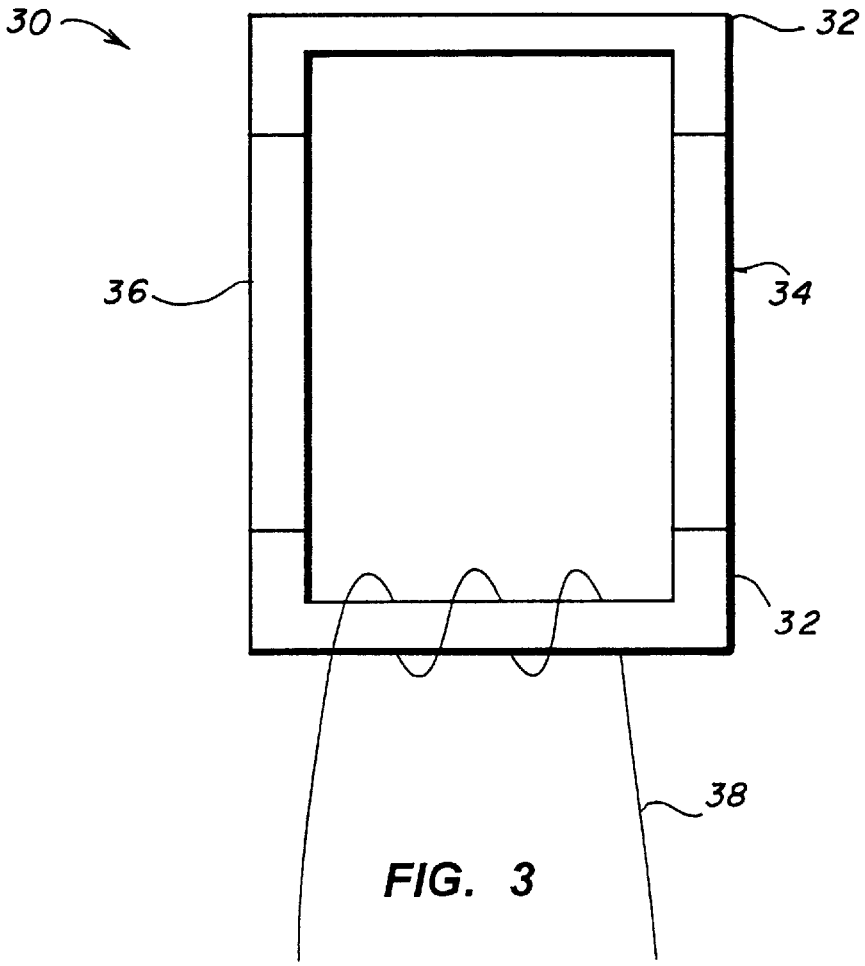
FIG. 3 shows one implementation of the tuning portion 30 shown in FIG. 2A.

One implementation of the tuning portion 15 is further detailed in FIG. 3 and shows the ferrite section 30 having high permeability material sections 32, a permanent magnet 34, a ferrite 36, and an electromagnet 38. The ferrite 36 may be a magnetic ferrite material such as a single crystal yttrium iron garnet (YIG) film.

The permanent magnet 34 produces a magnetic field that causes ferrite 36 to have a ferromagnetic resonate frequency near a frequency of the electromagnetic signal transmitted by the resonator system 10. The electromagnet 38 produces a second magnetic field and is variable in response to a varying current supplied to the electromagnet 38 to change the permeability of the ferrite element, thereby altering a magnetic field component of the electromagnetic signal. The magnetic field bias applied to the ferrite may be produced in other ways besides the use of an electromagnet. The use of an electromagnet is advantageous because the ferrite 36 only interacts with the permanent magnet 34 and the electromagnet 38 and the other portions of the system are isolated by positioning or electrical shielding. In a preferred embodiment, the magnetic field is oriented in the direction of propagation of the microwaves.

Figure 4:
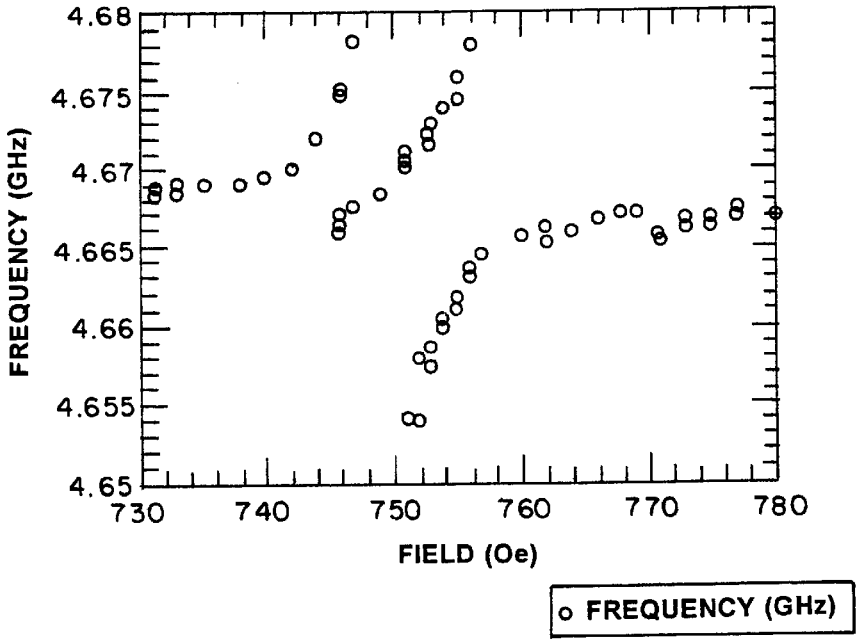
FIG. 4 shows a graph of the resonant frequency of a strip line ring resonator versus a magnetic field.

FIG. 4 shows a graph of the resonant frequency of a strip line ring resonator versus a magnetic field bias. The resonator in this example is made of YBCO superconductive material. A single crystal YIG film was positioned approximately 1 mm above the resonator in the configuration shown in FIG. 2A. The DC magnetic field was provided by an external electromagnet and the magnetic field was applied to the plane of the YIG film and the plane of the superconducting thin film circuit. The frequency shifts in the vicinity of the YIG film ferromagnetic resonance are evident in the three curves shown.

Figure 5:
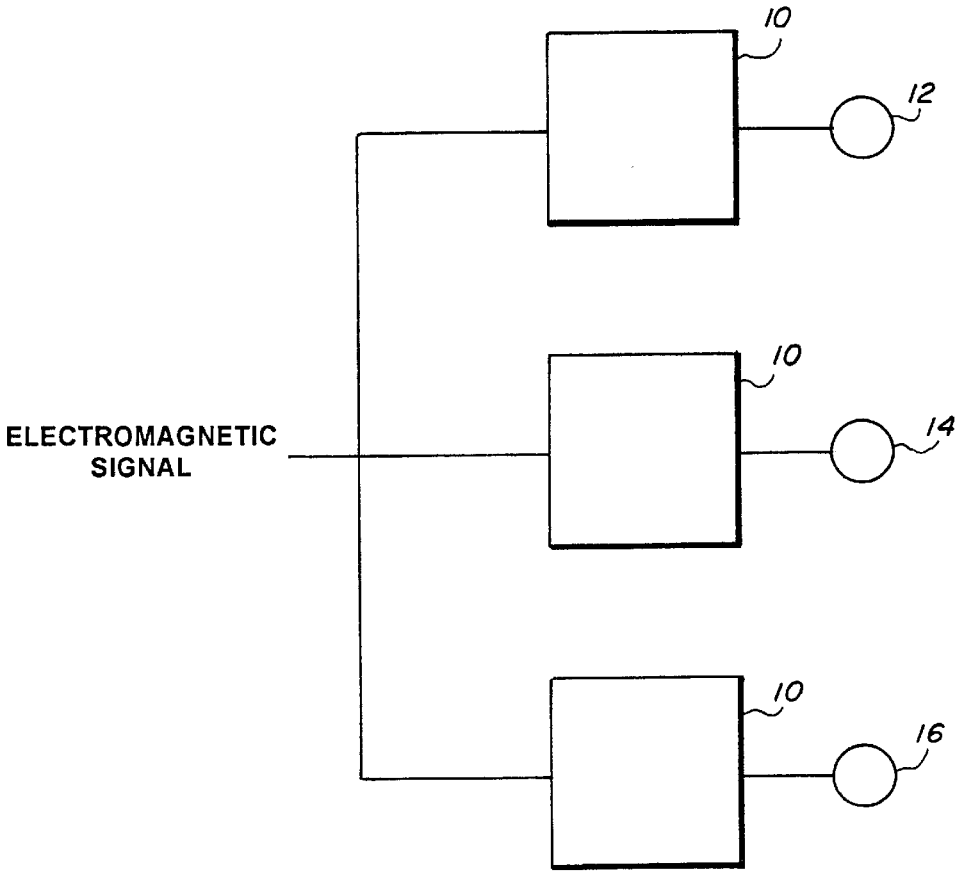
FIG. 5 shows a filter including a series of the resonator structure shown in FIG. 2A.

FIG. 5 shows a filter that includes the series of resonators such as that shown in FIG. 2A. An electromagnetic signal is input to a parallel line of resonators 10, each having a separate output port 12, 14, and 16, respectively. The microwave resonator structure 10 shown in FIG. 2A, may be used in a plurality of different filters such as bandpass filters, strip line filters, and cavity filters.

The present invention allows for affecting the resonant frequency of a resonator using small changes in a magnetic field applied to a ferrite, thereby allowing rapid changes to the resonant frequency which is important in many applications of resonators and filters.

The foregoing description of preferred embodiments of the present invention have been presented for purposes of illustration and description. It is not intended to be an exhaustive or delimit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalence.

What is claimed is:

1. An electromagnetic filter comprising:

a resonator portion including:

an input for receiving an electromagnetic signal; and an output for emitting said electromagnetic signal; and a superconductive resonant transmission line, connected in series between said input and said output, wherein said superconductive resonant transmission line includes a superconductive material intermingled with non-superconductive material; and a tuning portion coupled to said resonator portion, said tuning portion including:

a first source generating a first magnetic field;

a second source generating a second magnetic field; and a ferrite element located in said first and second magnetic fields and having a magnetic permeability, the magnetic permeability being a function of said first and second magnetic fields, wherein said ferrite element is separated from said transmission line by a discrete distance.

2. An electromagnetic filter in accordance with claim 1, wherein said transmission line has a stripline configuration.

3. An electromagnetic filter in accordance with claim 1, wherein said transmission line has a microstrip configuration.

4. An electromagnetic filter in accordance with claim 3, wherein said transmission line includes a signal line having a substantially annular portion.

5. An electromagnetic filter in accordance with claim 1, wherein said first source includes a permanent magnet and said second source includes an electromagnet.

6. An electromagnetic filter in accordance with claim 5, wherein said first magnetic field places a ferromagnetic resonance frequency of said ferrite element near a frequency of said electromagnetic signal transmitted by said resonator portion.

7. An electromagnetic filter in accordance with claim 5, wherein said second magnetic field is variable in response to a varying current supplied to said electromagnet to change said permeability of said ferrite element, thereby altering a center frequency of the resonator.

8. An electromagnetic filter in accordance with claim 1, wherein said electromagnetic signal includes a microwave signal.

9. An electromagnetic filter in accordance with claim 1, wherein said ferrite element includes a single crystal YIG film.

10. A bandpass filter comprising:

a plurality of filters connected in parallel, each filter comprising:

a resonant transmission line for transmitting electromagnetic radiation therethrough, wherein said resonant transmission line includes a superconductive material intermingled with non-superconductive material; and a tuning portion, said tuning portion including:

a first source generating a first magnetic field;

a second source generating a second magnetic field; and a ferrite element coupled to said transmission line and disposed in said first and second magnetic fields, wherein said ferrite element is separated from said transmission line by a discrete distance.

11. A bandpass filter in accordance with claim 10, wherein said first source includes a permanent magnet and said second source includes an electromagnet.

12. A bandpass filter in accordance with claim 10, wherein said ferrite element includes a single crystal YIG film.

13. A bandpass filter in accordance with claim 10, wherein said first magnetic field places a ferromagnetic resonance frequency of said ferrite element near a frequency of said electromagnetic radiation transmitted by said transmission line.

14. A bandpass filter in accordance with claim 11, wherein said second magnetic field is variable in response to a varying current supplied to said electromagnet to change said permeability of said ferrite element, so as to modulate a magnetic field component of said electromagnetic radiation in each of said plurality of filters.

15. A bandpass filter in accordance with claim 11, wherein said electromagnet includes a coil in coupled relation with said ferrite element and said permanent magnet.

16. A method for tuning a filter, said filter including a ferrite element disposed adjacent but not in contact with a resonant transmission line, said ferrite element provided in a first fixed magnetic field, said method comprising the steps of:

generating a second magnetic field;

subjecting said ferrite element to said second magnetic field;

varying said second magnetic field to change a magnetic permeability in said ferrite element, thereby modulating a magnetic field component of an electromagnetic signal carried by said resonant transmission line, wherein said resonant transmission line includes a superconductive material intermingled with non-superconductive material.

17. A method in accordance with claim 16, wherein said first fixed magnetic field places a ferromagnetic resonance frequency of said ferrite element near a frequency of said electromagnetic radiation.

18. A method in accordance with claim 16, wherein said varying step includes the steps of:

supplying a current to a conductive coil in coupled relation to said ferrite element to generate said second magnetic field; and altering said current to change said second magnetic field.

* * * * *